United States Patent [19]

Fisher et al.

[11] Patent Number: 4,701,200

[45] Date of Patent: Oct. 20, 1987

[54] PROCESS TO PRODUCE HELIUM GAS

[75] Inventors: Theodore F. Fisher, Tonawanda; Thomas C. Hanson, Buffalo; Joseph A. Weber, Cheektowaga, all of N.Y.

[73] Assignee: Union Carbide Corporation, Danbury, Conn.

[21] Appl. No.: 911,220

[22] Filed: Sep. 24, 1986

[51] Int. Cl.[4] ..... F25J 3/02

[52] U.S. Cl. ..... 62/27; 62/31; 62/32; 62/36; 62/42

[58] Field of Search ..... 62/22, 23, 24, 27, 28, 62/31, 32, 36, 42

[56] References Cited

U.S. PATENT DOCUMENTS

| | | | |
|---|---|---|---|
| 2,940,271 | 6/1960 | Jackson | 62/31 |
| 3,233,418 | 2/1966 | Shaievitz | 62/38 |
| 3,347,055 | 10/1967 | Blanchard et al. | 62/9 |
| 3,373,574 | 3/1968 | Fisher | 62/20 |
| 3,389,565 | 6/1968 | Ergenc | 62/9 |
| 3,512,368 | 5/1970 | Harper | 62/21 |
| 3,599,438 | 8/1971 | Blackwell et al. | 62/22 |
| 3,609,984 | 10/1971 | Garwin | 62/22 |
| 3,643,452 | 2/1972 | Ruhemann et al. | 62/22 |
| 3,719,053 | 3/1973 | DeMarco et al. | 62/22 |
| 3,740,962 | 6/1973 | Fan | 62/29 |
| 3,815,376 | 6/1974 | Lofredo et al. | 62/22 |
| 3,838,553 | 10/1974 | Doherty | 55/58 |
| 4,238,211 | 12/1980 | Stuart | 62/20 |
| 4,267,701 | 5/1981 | Toscano | 62/86 |
| 4,421,537 | 12/1983 | Kuraoka | 62/22 |

OTHER PUBLICATIONS

Design and Operating Characteristics of the Sunflower Helium Plant; Crawford and Harlan; Journal of Petroleum Technology; 9/70; pp. 1098–1102.

*Primary Examiner*—Ronald C. Capossela
*Attorney, Agent, or Firm*—Stanley Ktorides

[57] ABSTRACT

A process to produce helium gas from a feed to a nitrogen rejection unit comprising employing refrigeration from the nitrogen rejection unit to increase the recovery of helium by cooling crude helium prior to further processing.

12 Claims, 3 Drawing Figures

PROCESS TO PRODUCE HELIUM GAS

TECHNICAL FIELD

This invention relates to the production of helium gas from a natural gas reservoir and is an improvement whereby the helium gas recovery is higher than that attainable with conventional processes.

BACKGROUND ART

One very important source of helium is as a component in the gas stream from a natural gas reservoir. Because of the wide difference in the volatility of natural gas, which is essentially methane, and the volatility of helium, it is relatively easy to separate helium from natural gas.

Often, however, the gas stream from a natural gas reservoir also contains a significant amount of nitrogen. The nitrogen may be naturally occurring and/or may have been injected into the reservoir as part of an enhanced gas recovery or enhanced oil recovery operation. In this situation the gas stream from the reservoir, after certain precleaning operations to remove acid gases, water, and/or higher hydrocarbons, is passed to a nitrogen rejection unit or NRU wherein the methane is separated from the nitrogen by cryogenic rectification. The nitrogen fraction may comprise from 10 to 70 percent of the feed to the NRU. Due to the relative volatilities of these gases, the helium in the NRU feed is concentrated with the nitrogen. In order for the helium to be of commercially acceptable purity the helium-nitrogen mixture from the NRU must be separated.

This separation is relatively difficult and costly and consequently a significant portion of the helium is lost by remaining with the nitrogen.

It is therefore an object of this invention to produce helium gas from a nitrogen rejection unit simply and efficiently with high recovery.

SUMMARY OF THE INVENTION

The above and other objects which will become apparent to one skilled in the art upon a reading of this disclosure are attained by the present invention which is:

A process for the production of helium gas comprising:

(A) cooling, expanding and partially liquefying a feed comprising methane, nitrogen and helium;

(B) introducing resulting two-phase feed into a column operating at a pressure within the range of from 250 to 450 psia;

(C) within the column, separating the feed into methane liquid and nitrogen-helium vapor;

(D) withdrawing nitrogen-helium vapor from the column;

(E) partially condensing nitrogen-helium vapor to produce helium-richer vapor and nitrogen-richer liquid;

(F) partially condensing helium-richer vapor to produce crude helium gas and nitrogen-rich liquid;

(G) warming crude helium gas by indirect heat exchange with cooling feed;

(H) purifying crude helium gas to produce product helium gas and helium-containing waste gas; and (I) passing helium-containing waste gas to helium-richer vapor upstream of step (F).

The term "column" is used herein to mean a distillation, rectification or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For an expanded discussion of fractionation columns see the Chemical Engineer's handbook, Fifth Edition, edited by R. H. Perry and C. H. Chilton, McGraw-Hill Book Company, New York Section 13, "Distillation" B. D. Smith et al, page 13-3, *The Continuous Distillation Process.*

The term "double column", is used herein to mean a high pressure column having its upper end in heat exchange relation with the lower end of a low pressure column. An expanded discussion of double columns appears in Ruheman, "The Separation of Gases" Oxford University Press, 1949, Chapter VII, Commercial Air Separation, and Barron, "Cryogenic Systems", McGraw-Hill, Inc., 1966, p. 230, Air Separation Systems.

The term "indirect heat exchange" is used herein to mean the bringing of two fluid streams into heat exchange relation without any physical contact or intermixing of the fluids with each other.

DETAILED DESCRIPTION

The invention will be described in detail with reference to FIG. 1 which illustrates the process of this invention with use of a double column NRU.

Figure 1:
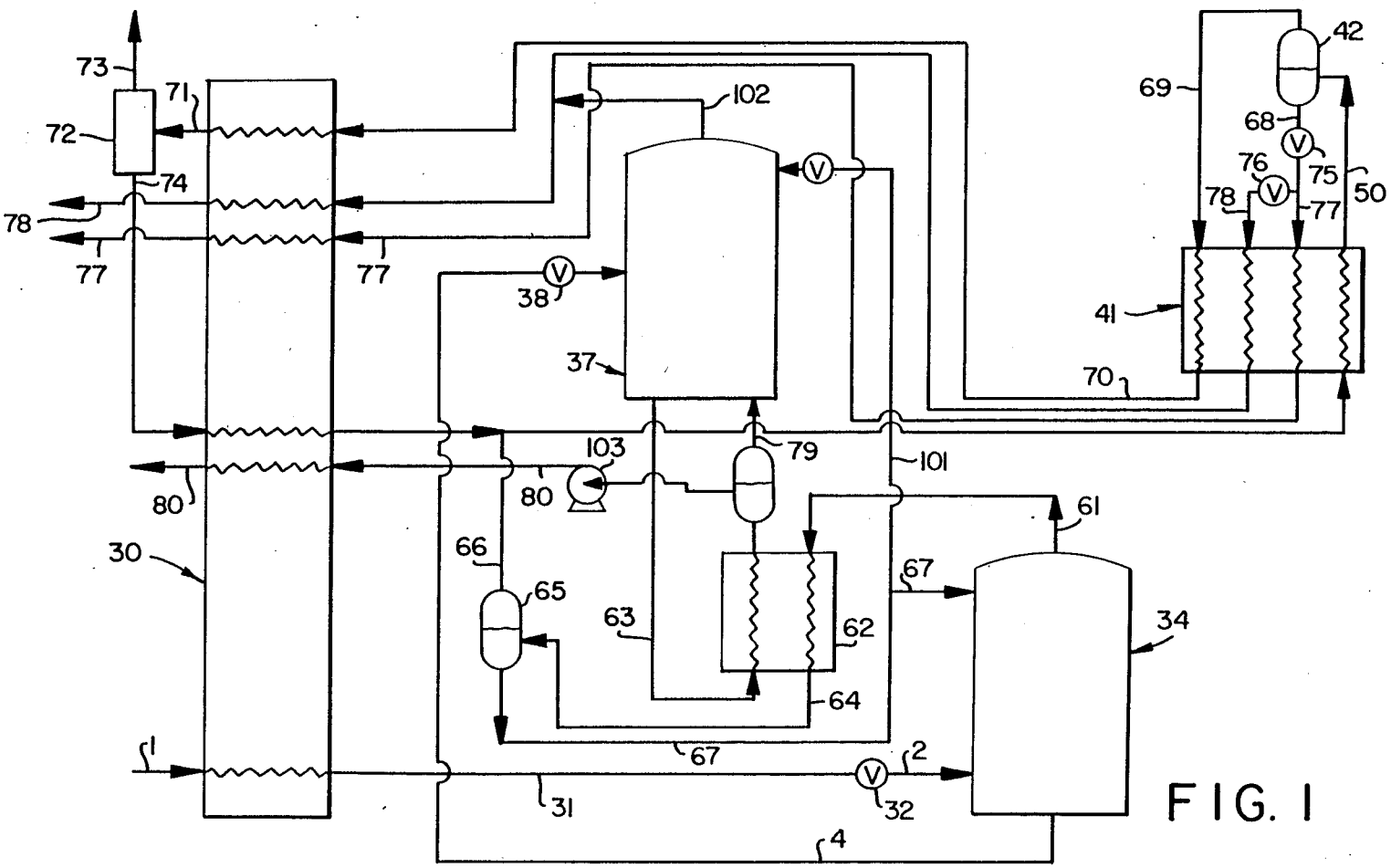
FIG. 1 is a simplified schematic flow diagram of one preferred embodiment of the helium gas production process of this invention.

Referring now to FIG. 1, gaseous feed stream 1 which comprises nitrogen, methane and helium and is generally at a pressure exceeding about 500 psia is cooled by passage through heat exchanger 30 to produce cooled gaseous feed 31. The gaseous feed is generally taken from a natural gas reservoir and may have been previously processed to remove water, acid gases and/or higher hydrocarbons. The gaseous feed may contain up to several percent helium and generally contains from about 0.5 to 3 percent helium. Cooled gaseous feed 31 is expanded, such as by passage through valve 32, to partially liquefy the feed, and the two-phase feed 2 is introduced into column 34.

Column 34 may be a single column, or as is illustrated in FIG. 1, may be the higher pressure column of a double column arrangement. The choice of using either a double column or a single column NRU is an engineering decision which can be made by anyone skilled in this art. Generally a double column NRU is preferred when the feed comprises 25 percent or more of nitrogen, and a single column NRU is preferred when the feed contains less than 25 percent nitrogen. The principles of operation of single and double column cryogenic rectification plants are well known to those skilled in the art and no further detailed description is necessary here.

Column 34 is operating at a pressure within the range of from 250 to 450 psia, preferably within the range of from 300 to 400 psia. Within column 34 the feed is separated into a methane liquid, i.e. a liquid having a methane concentration which exceeds that of the feed, and into a nitrogen-helium vapor, i.e. a vapor which has a nitrogen-helium concentration which exceeds that of the feed.

Most of the nitrogen-helium vapor is condensed and the resulting liquid is employed as liquid reflux for the column. In the double column embodiment illustrated in FIG. 1, nitrogen-helium vapor is withdrawn as stream 61 and partially condensed in heat exchanger 62 against partially vaporizing lower pressure column bottoms 63. The partially condensed stream 64 is passed to separator 65 and separated into helium-richer vapor 66 and nitrogen-richer liquid 67 which is returned to column 34 as reflux. A portion 101 of liquid 67 is expanded and passed into lower pressure column 37 as reflux. The lower pressure column operates at a pressure within the range of from 12 to 40 psia, preferably within the range of from 20 to 30 psia.

Helium-richer vapor 66 generally contains in excess of 30 percent helium. Vapor 66 is cooled and partially condensed by indirect heat exchange through heat exchanger 41 and resulting two phase stream 50 is passed to phase separator 42 and separated into nitrogen-rich liquid 68 and crude helium gas 69. Crude helium gas 69, which generally contains in excess of 80 percent helium, is passed through heat exchanger 41 wherein it is warmed by indirect heat exchange with condensing helium-richer vapor and then passed 70 through heat exchanger 30 wherein it is warmed by indirect heat exchange with cooling feed. Warmed helium gas 71 is passed to helium purifier 72 wherein it is separated into product helium gas 73, generally containing in excess of 99.99 percent helium, and helium-containing waste gas 74. Helium purifier 72 may be any effective helium purifier; a particularly preferred helium purifier is a pressure swing adsorption (PSA) helium purifier. Those skilled in the art are familiar with PSA units and no further detailed description is necessary here. In the case where purifier 72 is a PSA unit, stream 74 is PSA tail gas. Stream 74 is then cooled by passage through heat exchanger 30 and passed to helium-richer vapor 66 upstream of heat exchanger 41. In this way refrigeration within the nitrogen rejection unit is gainfully employed to increase the yield or recovery of helium which is taken from the NRU with the nitrogen.

FIG. 1 illustrates a preferred treatment of nitrogen-rich liquid 68 which is expanded through valve 75, a portion further expanded through valve 76, and both portions 77 and 78 passed through heat exchangers 41 and 30 and out of the process. Either or both portions 77 and 78 may be recovered in whole or in part or simply released to the atmosphere.

As indicated earlier, FIG. 1 illustrates a double column NRU wherein the feed is separated into nitrogen and methane. The nitrogen recovery is by withdrawal of top vapor from lower pressure column 37 as stream 102 which is passed out of the process, preferably by combination with stream 78 as shown in FIG. 1. Methane liquid is withdrawn from column 34 as stream 4, cooled by indirect heat exchange with return streams (not shown), expanded through valve 38 and introduced into lower pressure column 37. Within lower pressure column 37 the feed is separated by cryogenic rectification into nitrogen top vapor and methane bottom liquid. The methane bottom liquid is removed as stream 63 and partially vaporized by indirect heat exchange through heat exchanger 62. Resulting vapor 79 is returned to column 37 and resulting liquid 80 is pumped to a higher pressure 103, warmed and recovered as methane product.

Figure 2:
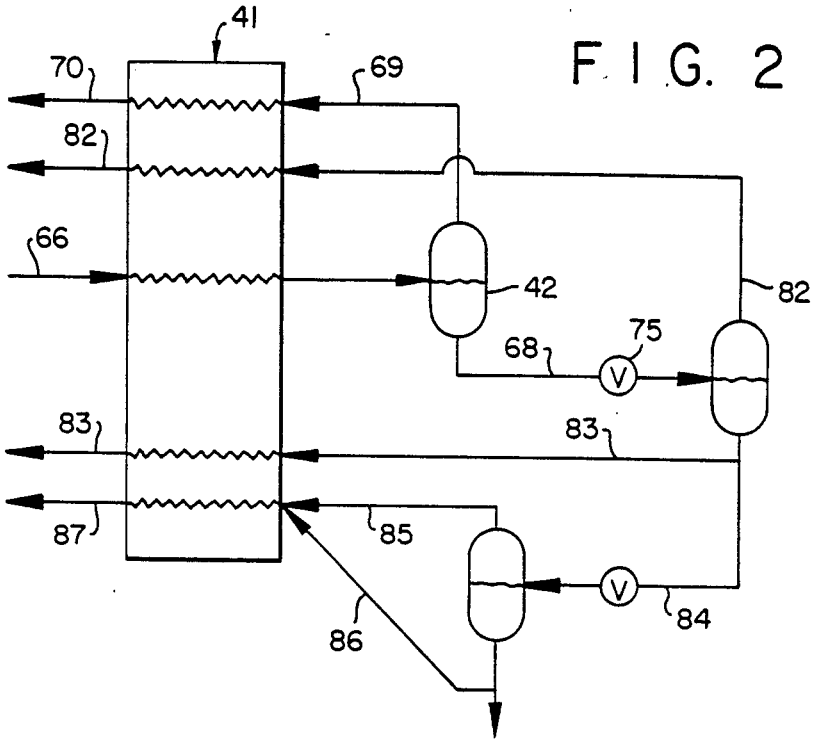
FIG. 2 is a schematic flow diagram of an alternative embodiment to the partial condensation of the helium-richer vapor of FIG. 1.

FIG. 2 illustrates an alternative to the partial condensation of the helium-richer vapor illustrated in FIG. 1. The FIG. 2 alternative is particularly preferred for use with a single column NRU. The numerals in FIG. 2 correspond to those of FIG. 1 for the common elements.

In the embodiment of FIG. 2, expanded nitrogen-rich liquid is not divided into two portions but rather is phase separated in separator 81 into vapor and liquid. The vapor 82 is warmed and preferably combined with helium-containing waste gas prior to the passage of the helium-containing waste gas to the helium-richer vapor. The liquid is divided into two portions. One portion 83 is warmed and passed out of the process while the other portion 84 is expanded, partially vaporized and separated, the vapor portion 85 and at least some 86 but not all of the liquid portion is recombined, and the combined stream 87 warmed and passed out of the process.

Figure 3:
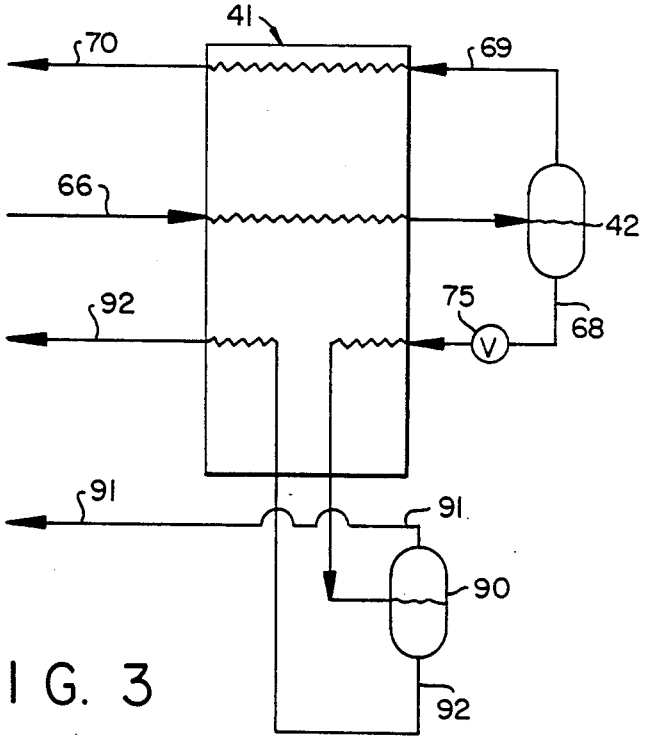
FIG. 3 is a schematic flow diagram of another alternative embodiment to the partial condensation of the helium-richer vapor of FIG. 1.

FIG. 3 illustrates another alternative to the partial condensation of the helium-richer vapor illustrated in FIG. 1. The numerals in FIG. 3 correspond to those of FIG. 1 for the common elements.

In the embodiment of FIG. 3 expanded nitrogen-rich liquid partially traverses heat exchanger 41 and is partially vaporized. The two-phase stream is separated in separator 90. The vapor 91 is passed out of the process and preferably combined with helium-containing waste gas prior to the passage of the helium-containing waste gas to the helium-richer vapor. The liquid 92 partially traverses heat exchanger 41 and is passed out of the process.

The following tabulation in Table I represents the results of a computer simulation of the process of this invention carried out with the embodiment illustrated in FIG. 1. The stream numbers in Table I correspond to those of FIG. 1.

TABLE I

| Stream Number | 1 | 2 | 66 | 69 | 74 | 50 |
|---|---|---|---|---|---|---|
| Flow, lb mole/hr | 1000 | 1000 | 49.7 | 23.1 | 7.7 | 49.7 |
| Temperature, K | 260.9 | 142.9 | 110.9 | 87.5 | 310.9 | 87.5 |
| Pressure, psia | 1005 | 400 | 400 | 400 | 400 | 400 |
| Phase | Vapor | 2-phase | Vapor | Sat. Vap. | Vapor | 2-phase |
| Composition, mole % | | | | | | |
| Helium | 1.7 | 1.7 | 37.3 | 86.5 | 59.6 | 40.7 |
| Nitrogen | 41.1 | 41.1 | 62.6 | 13.5 | 40.4 | 59.2 |
| Methane | 57.2 | 57.2 | 0.1 | — | — | 0.1 |

Now, by the process of this invention, one can effectively employ refrigeration from an NRU to increase the recovery of helium gas from a reservoir stream.

Although the process of this invention has been described in detail with reference to certain specific embodiments, those skilled in the art will recognize that there are other embodiments of this invention within the spirit and scope of the claims.

We claim:

1. A process for the production of helium gas comprising:

(A) cooling, expanding and partially liquefying a feed comprising methane, nitrogen and helium;

(B) introducing resulting two-phase feed into a column operating at a pressure within the range of from 250 to 450 psia;

(C) within the column, separating the feed into methane liquid and nitrogen-helium vapor;

(D) withdrawing nitrogen-helium vapor from the column;

(E) partially condensing nitrogen-helium vapor to produce helium-richer vapor and nitrogen-richer liquid;

(F) partially condensing helium-richer vapor to produce crude helium gas and nitrogen-rich liquid;

(G) warming crude helium gas by indirect heat exchange with cooling feed;

(H) purifying crude helium gas to produce product helium gas and helium-containing waste gas; and (I) passing helium-containing waste gas to helium-richer vapor upstream of step (F).

2. The process of claim 1 wherein the feed comprises from 0.5 to 3 percent helium.

3. The process of claim 1 wherein the column is the single column of a single column cryogenic nitrogen rejection unit.

4. The process of claim 1 wherein the column is the high pressure column of a double column cryogenic nitrogen-rejection unit.

5. The process of claim 1 wherein the crude helium gas is purified by pressure swing adsorption.

6. The process of claim 1 wherein the product helium gas has a helium-concentration in excess of 99.99 percent.

7. The process of claim 1 wherein the partial condensation of step (F) is carried out at least in part by indirect heat exchange with nitrogen-rich liquid.

8. The process of claim 7 wherein the nitrogen-rich liquid is expanded, divided into two portions, and one of said portions is further expanded prior to said indirect heat exchange.

9. The process of claim 7 wherein the nitrogen-rich liquid is expanded and partially vaporized, the resulting liquid divided into two portions, and one of said portions is expanded and partially vaporized prior to said indirect heat exchange.

10. The process of claim 9 wherein resulting vapor from the expansion of nitrogen-rich liquid is combined with helium-containing waste gas upstream of step (I).

11. The process of claim 7 wherein the nitrogen-rich liquid is expanded, partially vaporized by indirect heat exchange with helium-richer vapor, separated into vapor and liquid portions, and the liquid portion further warmed by indirect heat exchange with helium-richer vapor.

12. The process of claim 11 wherein said vapor portion is combined with helium-containing waste gas upstream of step (I).

* * * * *